US008127582B2

(12) United States Patent
Johnson-Morke et al.

(10) Patent No.: US 8,127,582 B2
(45) Date of Patent: Mar. 6, 2012

(54) HIGH VELOCITY FORMING OF MEDICAL DEVICE CASINGS

(75) Inventors: Linda M. Johnson-Morke, New Brighton, MN (US); Glenn S. Daehn, Columbus, OH (US)

(73) Assignee: Medtronic, Inc., Minneapolis, MN (US)

( * ) Notice: Subject to any disclaimer, the term of this patent is extended or adjusted under 35 U.S.C. 154(b) by 573 days.

(21) Appl. No.: 12/339,890

(22) Filed: Dec. 19, 2008

(65) Prior Publication Data

US 2010/0154502 A1 Jun. 24, 2010

(51) Int. Cl.
*B21D 26/12* (2006.01)
*B21D 22/12* (2006.01)

(52) U.S. Cl. ..... 72/56; 72/60; 72/430; 72/707; 29/419.2

(58) Field of Classification Search ..... 72/54, 56, 72/60, 63, 430, 707; 29/419.2, 421.2, 802
See application file for complete search history.

(56) References Cited

U.S. PATENT DOCUMENTS 3,232,086 A * 2/1966 Inoue ..... 72/56
(Continued)

*Primary Examiner* — David Jones

(57) ABSTRACT

Methods and devices provide for high velocity forming of medical device casings. The high velocity forming may be produced by creating a pressure wave within a liquid contained by an enclosure. A die and a workpiece adjacent to the die are in the path of the pressure wave within the enclosure and the pressure wave forces the workpiece to conform to the contours of the die. Objects may be adhered to the die to provide for customized contours. Trimming features may be included within the enclosure to trim excess material from a formed workpiece as an integral part of the forming process. Various other features may also be provided within the enclosure including a diffuser to disperse the pressure wave. The workpiece may be of various forms including flat sheet stock.

36 Claims, 13 Drawing Sheets

U.S. PATENT DOCUMENTS 3,894,925 A * 7/1975 Inoue ..... 204/274
4,061,139 A * 12/1977 Kauffmann ..... 72/56
6,591,649 B1 * 7/2003 Gafri et al. ..... 72/56
6,708,542 B1 * 3/2004 Gafri et al. ..... 72/56
7,493,787 B2 * 2/2009 Golovashchenko et al. ..... 72/63
7,516,634 B1 * 4/2009 Golovashchenko et al. ..... 72/54
7,802,457 B2 * 9/2010 Golovashchenko et al. ..... 72/56
7,810,366 B2 * 10/2010 Golovashchenko ..... 72/55

* cited by examiner

HIGH VELOCITY FORMING OF MEDICAL DEVICE CASINGS

TECHNICAL FIELD

Embodiments of the present application are directed to high velocity forming of components. More particularly, embodiments are directed to the high velocity forming of medical device casings.

BACKGROUND

Medical devices such as cardiac stimulators and neurological stimulators are often constructed of two halves brought together during manufacturing to form a casing that encloses electrical circuitry. Considering that a medical device is in contact with the patient, and in many cases implanted into the patient's body, a biocompatible material is usually chosen for the casing halves. The biocompatible material that is commonly chosen is titanium or a titanium alloy. The recharging of medical devices, particularly implanted ones, through inductive coupling techniques has lead to a greater demand for titanium alloy casings.

Forming the casing halves from a material such as titanium or especially a titanium alloy presents many challenges. Conventionally, titanium casing halves are formed using a hard tool and die process. This process requires the manufacturing of the tooling itself which can take a significant amount of time and present significant costs to the manufacturer. Therefore, customization of appearance, feel, and the like on a small scale is not possible using conventional forming because the production of customized tooling is infeasible.

Furthermore, with the emergence of titanium alloys as a popular choice for casings where recharging will be expected, the problems are greater. With titanium alloys, the lack of customization continues to be a consequence of using conventional forming techniques. Additionally, titanium alloys are notoriously difficult to form into even a standard casing half using conventional forming processes. As a result, the efficiency of manufacturing is reduced to even less than that achieved using pure titanium.

SUMMARY

Embodiments address issues such as these and others by providing high velocity forming techniques and devices. High velocity forming provides for rapid manufacturing of both pure titanium and titanium alloy casing halves. Efficiency may be increased by including the trimming of the workpiece as an integrated step in the forming process. Furthermore, high velocity forming allows customization to be achieved by using a standard die with customized attachments for purposes of varying the resulting contour of the casing half including overall shape, the surface finish, and/or other aspects.

Embodiments include a method of creating casings of medical devices. The method involves providing an enclosure having a first area where a die is present, the die having a surface with a first contour corresponding to a desired contour of a casing section for an implantable medical device. The method further involves placing a first workpiece within the enclosure adjacent the die and at least partially filling the enclosure with a liquid. The method also involves creating a first spark within the liquid to produce a pressure wave that forces the first workpiece into the die and causes the first workpiece to achieve the first contour.

Embodiments include other methods of creating casing sections of medical devices. The method involves providing an enclosure having a first area where a die is present, the die having a surface with a first contour. The method involves affixing a first object having a first object contour to the surface of the die at a desired location so that the first object contour and the first contour are combined to provide a second contour. The method further involves placing a first workpiece within the enclosure adjacent the die and at least partially filling the enclosure with a liquid. The method also involves creating a first spark within the liquid to produce a pressure wave that forces the first workpiece into the die and causes the first workpiece to achieve the second contour.

Embodiments include a device for creating casing sections of medical device. The device includes an enclosure, a pair of electrodes within the enclosure that define a spark gap, a die having a first contour, and a first object removably affixed to the die. The first object has a first object contour, the first object contour and the first contour forming a second contour.

Embodiments include a method of creating casing sections of medical devices. The method involves providing an enclosure having a first area where a die is present, the die having a surface with a first contour, the die further having a contour edge and having extendable cutting blade around the contour edge. The method involves placing a first workpiece within the enclosure adjacent the die and at least partially filling the enclosure with a liquid. While the extendable cutting blade is in a retracted state, the method involves creating a first spark within the liquid to produce a pressure wave that forces the first workpiece into the die and causes the first workpiece to achieve the first contour. After creating the first spark, the method involves extending the cutting blade to an extended state. While the extendable cutting blade is in the extended state, the method involves creating a second spark within the liquid to produce a pressure wave that forces the first workpiece into the cutting blades to trim the workpiece along the contour edge.

Embodiments include a device for creating casing sections of medical devices. The device includes an enclosure, a pair of electrodes within the enclosure and defining a spark gap, a die within the enclosure and having a first contour and a contour edge, and a cutting blade that extends and retracts about the contour edge.

Embodiments include a method of creating casing sections of medical devices. The method involves providing an enclosure having a first area where a die is present, the die having a surface with a first contour corresponding to a desired contour of a casing section. The method involves placing a first workpiece comprising flat sheet stock within the enclosure adjacent the die and at least partially filling the enclosure with a liquid. The method further involves creating a first spark within the liquid to produce a pressure wave that forces the flat sheet stock of the first workpiece into the die and causes the flat sheet stock of the first workpiece sheet to achieve the first contour.

Embodiments include a method of creating casing sections of medical devices. The method involves providing an enclosure having a first area where a die is present, the die having a surface with a first contour. The method involves placing a first workpiece within the enclosure adjacent the die and at least partially filling the enclosure with a liquid. The method further involves creating a first spark within the liquid to produce a pressure wave that forces the first workpiece into the die and causes the first workpiece to achieve the first contour and diffusing the pressure wave as it travels to the first workpiece.

Embodiments include a device for creating casing sections of medical devices. The device includes an enclosure containing a liquid, a pair of electrodes within the enclosure and defining a spark gap within the liquid, a die within the liquid and having a first contour, and a pressure wave diffuser within the liquid and between the spark gap and the die.

DETAILED DESCRIPTION

Figure 1:
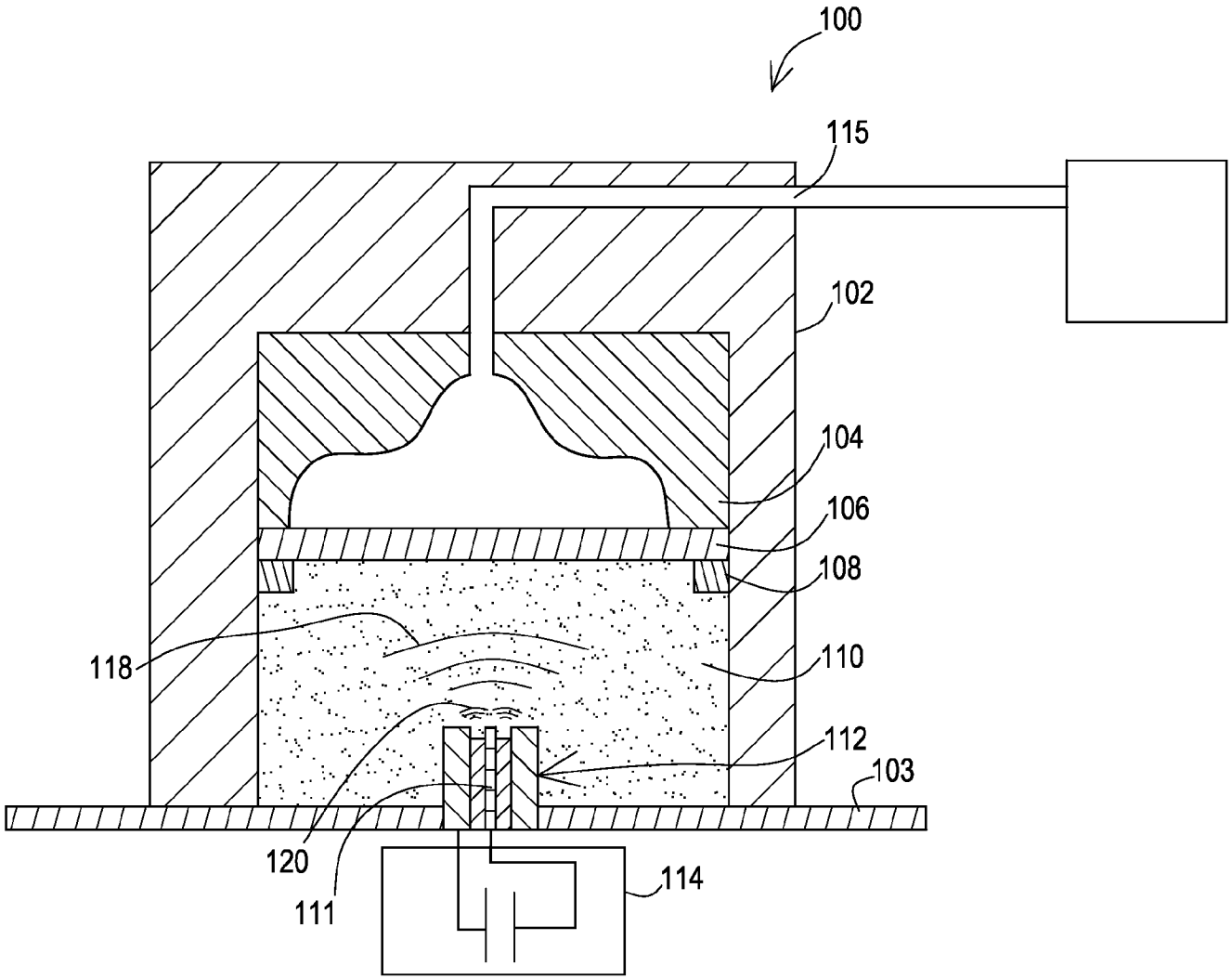
FIG. 1 shows one illustrative embodiment of a device for high velocity forming of components for medical devices.

Embodiments provide methods and devices for high velocity forming of components used when making medical devices. The high velocity forming may be used for various materials including titanium and titanium alloys. The high velocity forming may allow for customization of components being formed by allowing contour adjustments to be made on a standard die. Furthermore, the high velocity forming may include trimming as an integrated part of the forming operation to further increase the efficiency.

High velocity forming of components such as casing halves may be achieved by creating a pressure wave within an enclosure that includes a workpiece adjacent to a die. The pressure wave forces the workpiece to form to the contours of the die. An example of a device 100 for providing high velocity forming is shown in the cutaway view of FIG. 1.

The device 100 includes an enclosure 102. The enclosure 102 provides a rigid structure that can withstand the internal forces produced by a pressure wave 118 that will be generated to cause the forming of a workpiece 106. The pressure wave 118 may be created within a liquid 110 present within the enclosure 102, and the enclosure 102 retains the liquid 110. The enclosure 102 may be constructed of a rigid material. For longevity, it may be desirable to construct the enclosure 102 of materials with non-corrosive properties, such as stainless steel.

In the embodiments shown, the liquid 110 present within the enclosure 102 allows for the pressure wave 118 to be created within the liquid 110 by the presence of an electrical discharge, or spark 120. The liquid 110 may be of various forms such as water or other electrolytic solutions. The spark 120 may be produced by electrodes 111, 112 present within the enclosure 102 in proximity to one another so as to create a spark gap between them. In this particular embodiment, the enclosure 102 includes a base 103 upon which the electrodes 111, 112 are mounted. One electrode of the pair acts as a cathode while the other acts as an anode.

Energy is provided to the electrode pair 111, 112 by way of an energy source, such as a capacitor bank 114 as shown for this embodiment. The capacitor bank 114 allows for gradual increase of stored energy while also allowing for a rapid, high power release of the stored energy at an appropriate time into the electrode pair.

Opposite the electrode pair 111, 112, a die 104 is present to receive the workpiece 106 upon application of the pressure wave 118. The die 104 may be constructed of a material like that of the enclosure 102, such as stainless steel, so as to provide a rigid structure capable of forming the workpiece 106 that is moving at a relatively high velocity while also surviving within the liquid environment of the enclosure 102.

The workpiece 106 may be held in place by a holder 108. The holder 108 may take the form of a ring surrounding an outer edge of the workpiece 106 while leaving the inner region of the workpiece 106 exposed to the pressure wave 118. The holder 108 may be fixed to the walls of the enclosure 102.

In the example shown in FIG. 1, the workpiece 106 is a flat sheet stock as opposed to a tube stock. However, it will be appreciated that a tube stock may also be used in some cases. Some examples of the workpiece 106 for producing medical device casings include pure titanium, titanium alloys examples of which include grades 5, 9, 23, and so forth as well as other materials including niobium, tantalum, nickel-cobalt-chromium-molybdenum alloys such as an MP35N® alloy of SPS Technologies, Inc., superalloys such as a HASTELLOY® alloy of Haynes International, Inc., and the like. The workpiece 106 thickness may vary significantly from one workpiece to the next and/or within a given workpiece. For instance, in one example, workpieces of flat sheet stock may have thicknesses ranging from about a 0.025 inch to a 0.002 inch.

The space between the surface of the die 104 and the workpiece 106 will be eliminated by the pressure wave 118 forcing the workpiece 106 to conform to the die 104. Therefore, matter that exists between the die 104 and the workpiece 106 is evacuated by a vacuum line 115 and a vacuum pump 116 to prevent the presence of any matter from distorting the conformance of the workpiece 106 to the die 104.

As one example of this high velocity forming process, a workpiece 106 made of grade 9 titanium and having a thickness of a 0.010 inch and a diameter of 3.5 inches may be formed into a casing half. Energy on the order of 2.5 kJ for an enclosure volume of about one pint of liquid such as water or other electrolytic solutions results in the workpiece 106 achieving a velocity on the order of 150 feet per second. The workpiece 106 of this particular example may achieve a contour depth of the die 104 that is on the order of a 0.5 inch.

Figure 2:
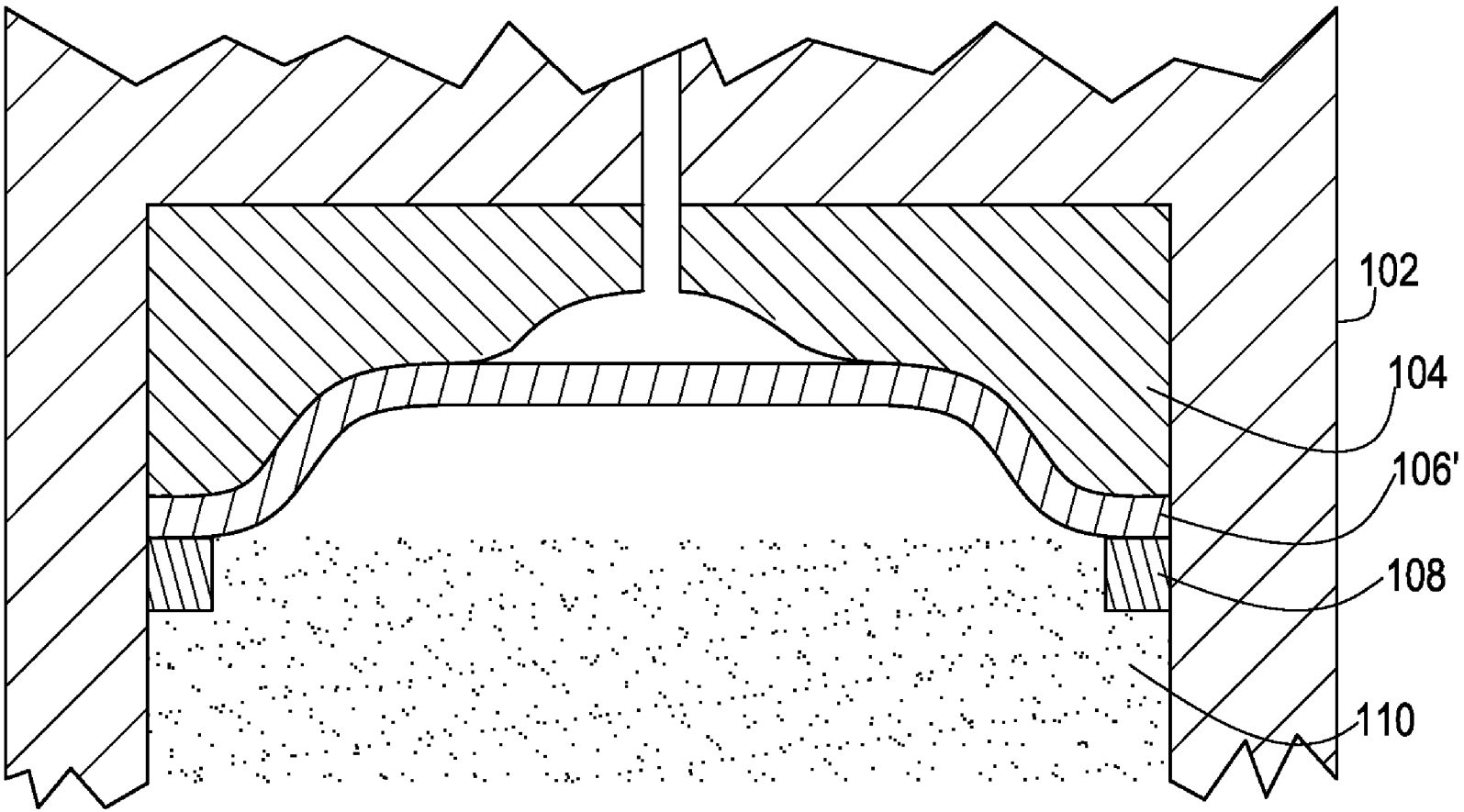
FIG. 2 shows a casing half from once formed within the illustrative embodiment of FIG. 1.

Once the pressure wave 118 strikes the workpiece 106, the workpiece 106' conforms to the contours of the die 104 as shown in FIG. 2. At this time, the workpiece 106' remains held in place by the holder 108. The workpiece 106' is released from the holder 108 and then removed from the enclosure 102. The holder 108 may be removable from the enclosure wall 102 to free the workpiece 106'. Furthermore, the enclosure 102 may include a panel such as in a top surface or a side surface that may open to allow access to the workpiece 106'. This access allows for retrieval of the current workpiece as well as installation of a subsequent workpiece 106'.

Figure 3:
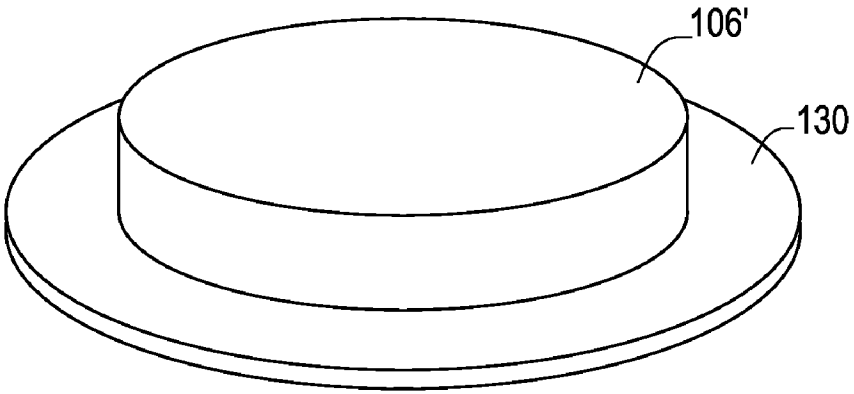
FIG. 3 shows the casing half from FIG. 2 once formed and prior to trimming.
Figure 4:
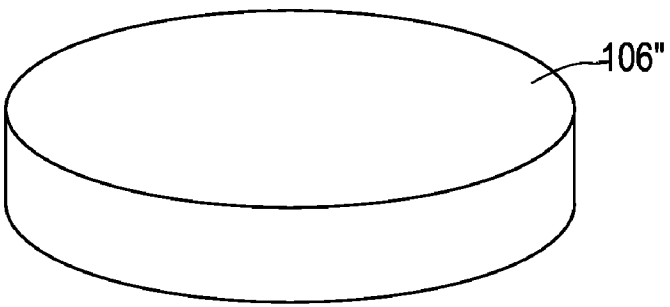
FIG. 4 shows the casing half from FIG. 3 once formed and trimmed.

The workpiece 106' is shown in FIG. 3 once formed but before an outer lip 130 has been trimmed. The outer lip 130 is the portion of the workpiece 106' that was held by the holder 108 and was outside of a contour edge of the die 104. The workpiece 106" shown in FIG. 4 has been trimmed to remove the lip 130 and is ready for subsequent manufacturing processes such as surface finishing, if any, and final assembly.

Figure 5:
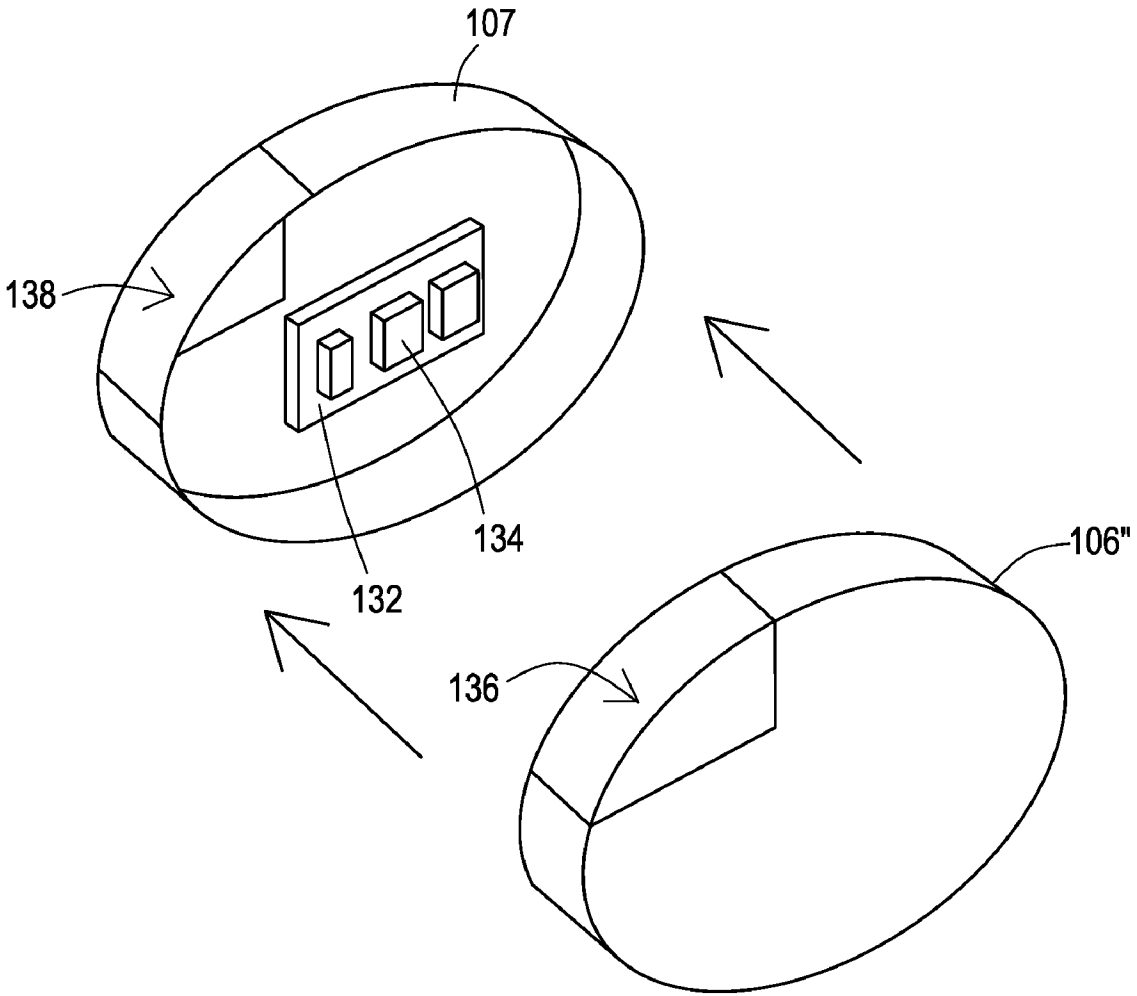
FIG. 5 shows two casing halves once formed being brought together to enclose electrical circuitry of a medical device.

FIG. 5 shows a later assembly step where two casing halves 106" and 107 are being mated. These casing halves 106", 107 form an enclosure for one or more circuit boards 132 that include electrical circuitry 134. This electrical circuitry 134 may provide various medical functions such as generating defibrillator shocks, providing muscle or neurological tissue stimulation, providing physiological sensing, and the like. The casing halves 106" and 107 may have received further processing to create notches in the areas 136, 138 where a lead connector mounts to the enclosure. Signals may be passed between the circuitry 134 and leads extending to various parts of a patient through the lead connector present at the areas 136, 138.

Figure 6:
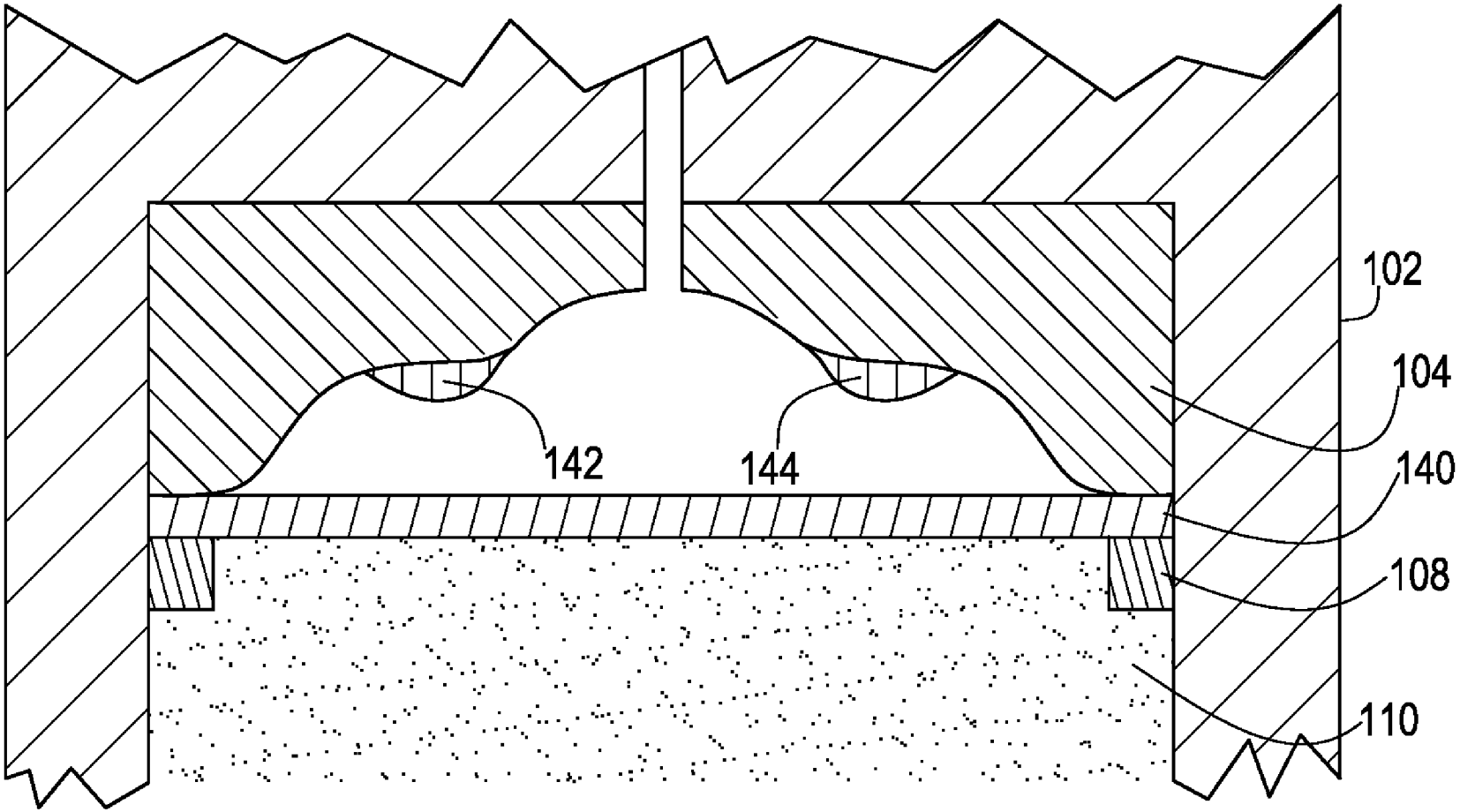
FIG. 6 shows the illustrative embodiment of FIG. 1 with objects affixed to a die to alter the contour.

FIG. 6 shows a cutaway view of the enclosure 102 and illustrates that one or more objects 142, 144 may be affixed to the surface of the die 104 to provide customization to the contour of the die 104 and the resulting casing halves or if desired, the surface of the die 104 itself may be provided with such a contour such as that being provided by the objects 142, 144. It may be desirable to customize a contour of a casing half with variations in shape relative to a standard die 104 for purposes of accommodating the physiology of the intended patient, providing decoration, and so forth. As can be seen, the objects 142, 144 each have a contour, and when positioned upon the surface of the die 104, create a new contour in conjunction with the contour of the die 104.

The one or more objects 142, 144 may be adhered to the surface of the die 104 at the desired location using a releasable adhesive so that the objects may be removed and/or replaced from one run of the device 100 to the next or may be adhered in a permanent fashion. Thus, where the objects 142, 144 are releasable, an entirely different customized contour may be available for each run using the same die 104. The one or more objects 142, 144 may also be constructed of a material such as stainless steel that retains its shape under the pressures being applied to the workpiece 140 and die 104 and that survives the liquid environment of the enclosure 102.

Figure 7:
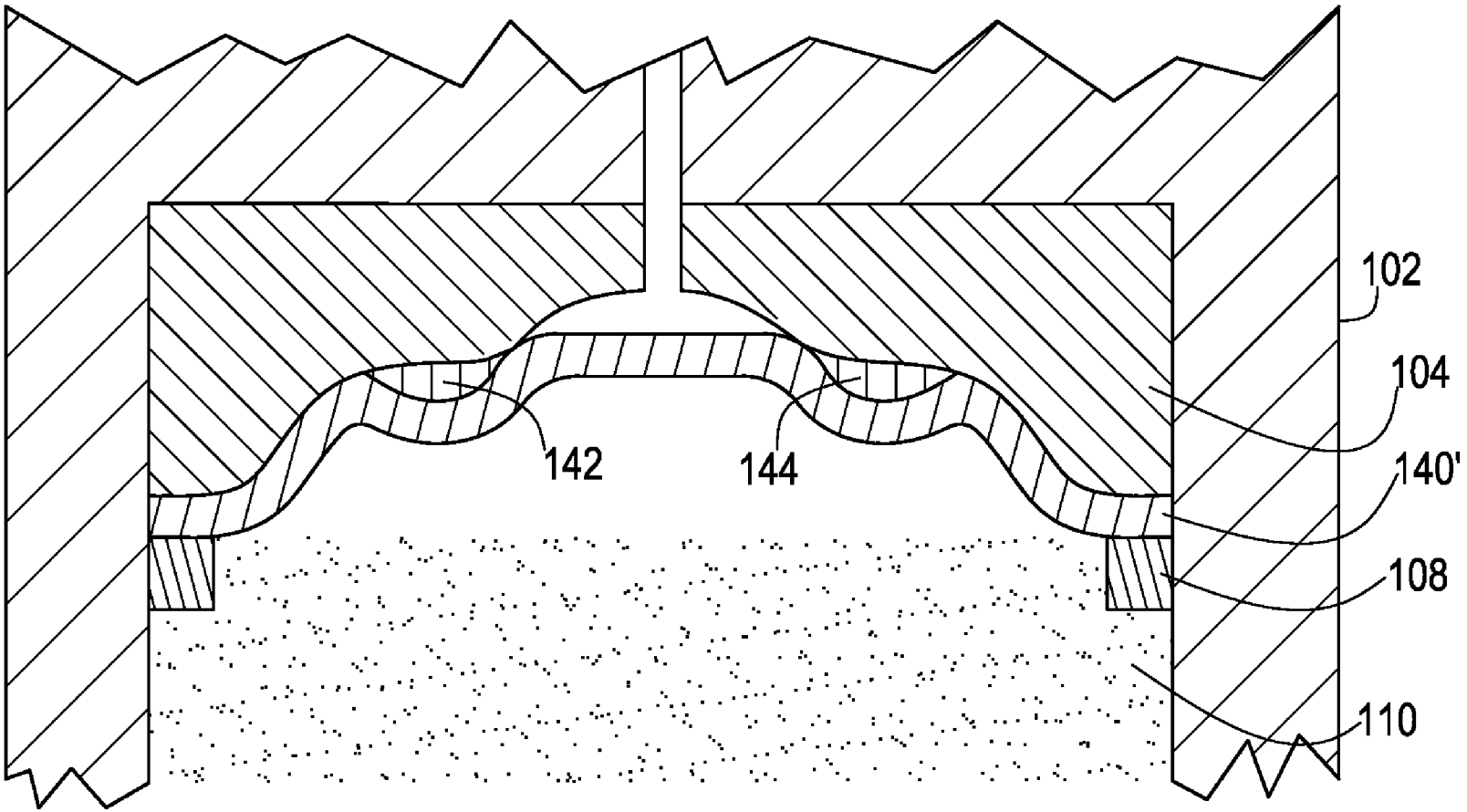
FIG. 7 shows a casing half once formed within the illustrative embodiment of FIG. 6.
Figure 8:
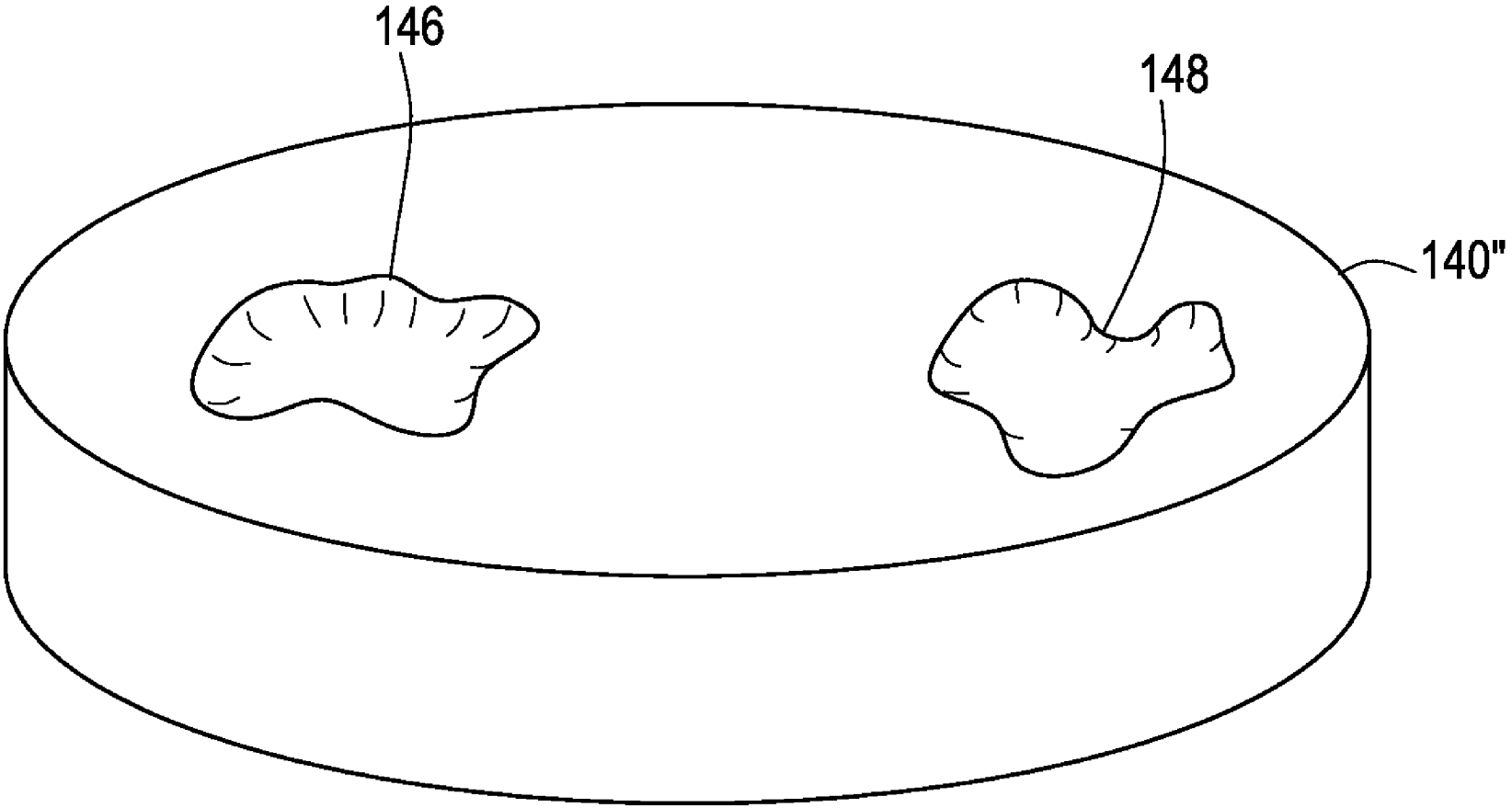
FIG. 8 shows the casing half from FIG. 5 once formed and trimmed.

Upon applying the pressure wave 118, the workpiece 140' has conformed to the contour provided by the combination of the die 104 and the objects 142, 144 as shown in FIG. 7. Upon removal of the workpiece 140' from the enclosure 102 and upon trimming of the workpiece 140', the workpiece 140" of FIG. 8 is achieved. The workpiece 140" includes indentions 146, 148 corresponding to the objects 142, 144 that were applied to the die 104.

Figure 9:
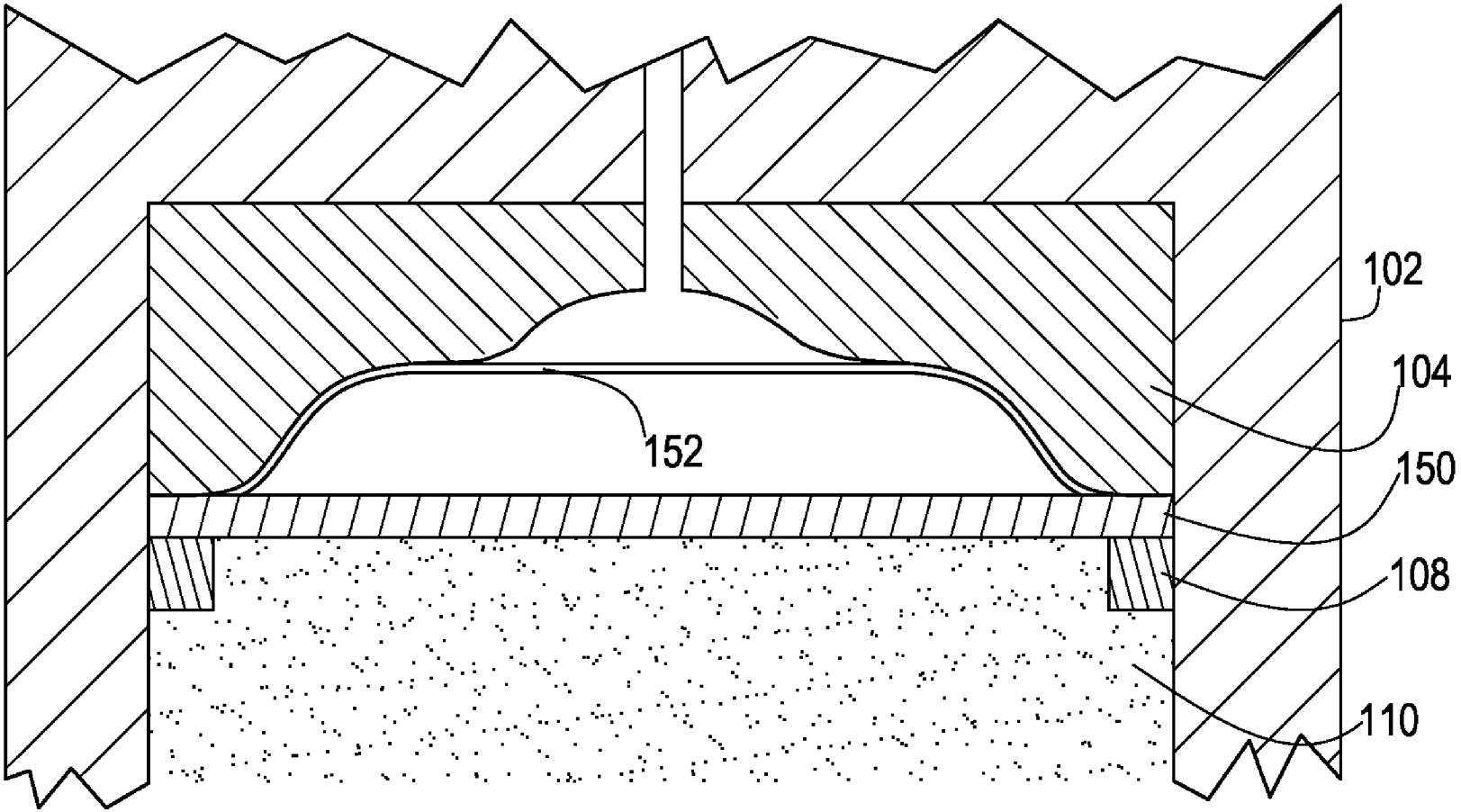
FIG. 9 shows the illustrative embodiment of FIG. 1 with another object fixed to the die to alter the contour.

The example of FIGS. 6-8 shows a customization of contour by altering the shape of the resulting casing half 140". In FIG. 9, this example provides a customization of contour by providing a surface finish treatment. The standard die 104 may have a contour with a smooth surface finish that provides no surface finish to a smooth workpiece 150. However, a contour with a surface finish other than the surface finish that the workpiece 150 currently has may be desired. An object 152 may be adhered permanently or releasably to the surface of the die 104 to provide the desired surface finish or if desired, the surface of the die 104 itself may be provided with such a non-smooth surface finish to impart to the workpiece 150. For example, the object 152 may be a screen or other sheet that forms a grid, dimples, pits, roughness, minute undulations, and so forth. The high velocity forming transfers the surface finish of the object 152 onto the workpiece 150.

Figure 10:
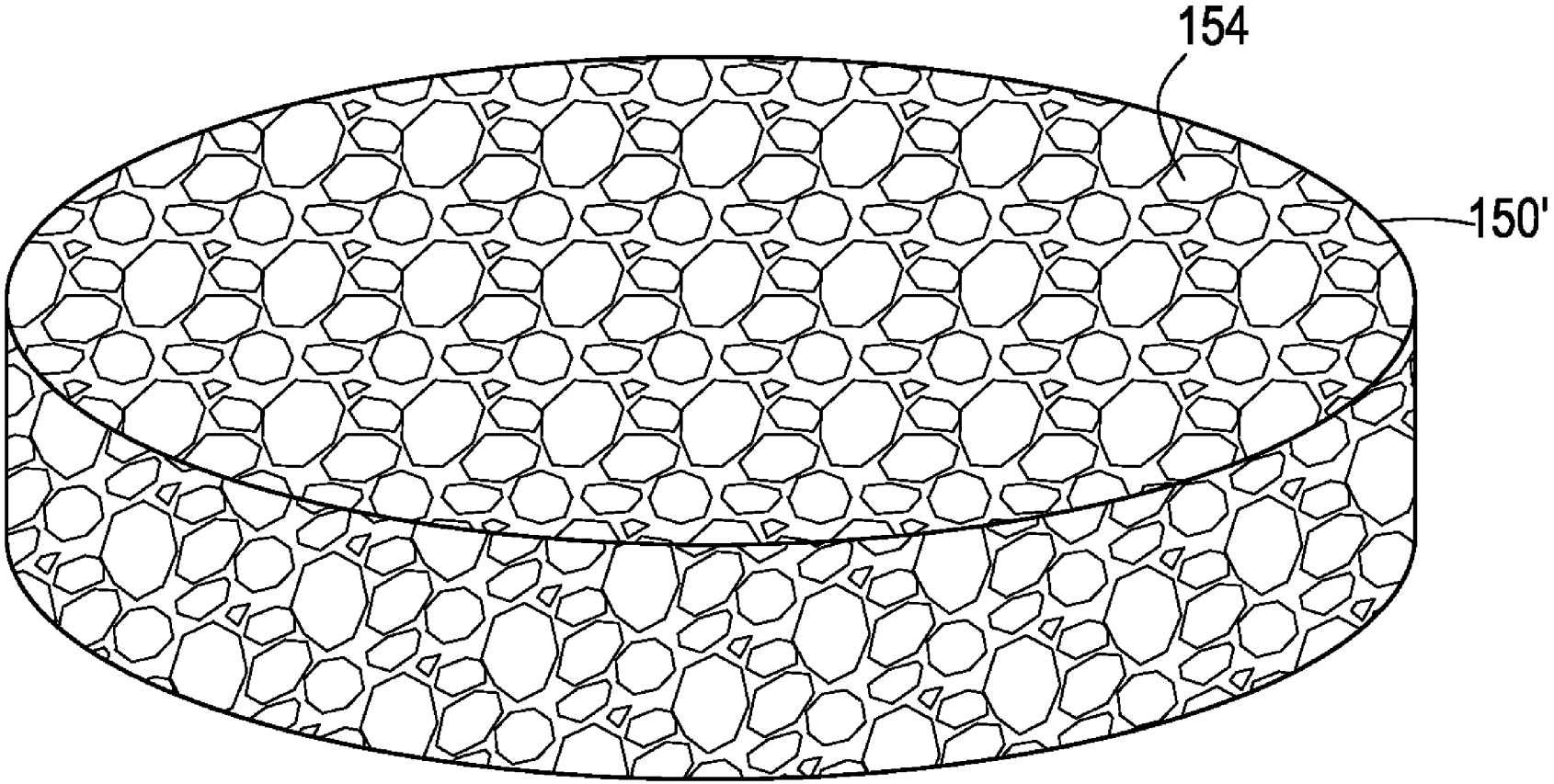
FIG. 10 shows the casing half formed from the illustrative embodiment of FIG. 5 once formed and trimmed.

In the example of FIG. 10, the workpiece 150' has been formed using the embodiment of FIG. 9 and has been trimmed. The workpiece 150' includes surface finish features 154 corresponding to the surface finish features of the object 152. The surface finish features of the resulting contour may also be for functional purposes such as fixation, enhanced biocompatibility, for decorative purposes, and so forth.

Figure 11:
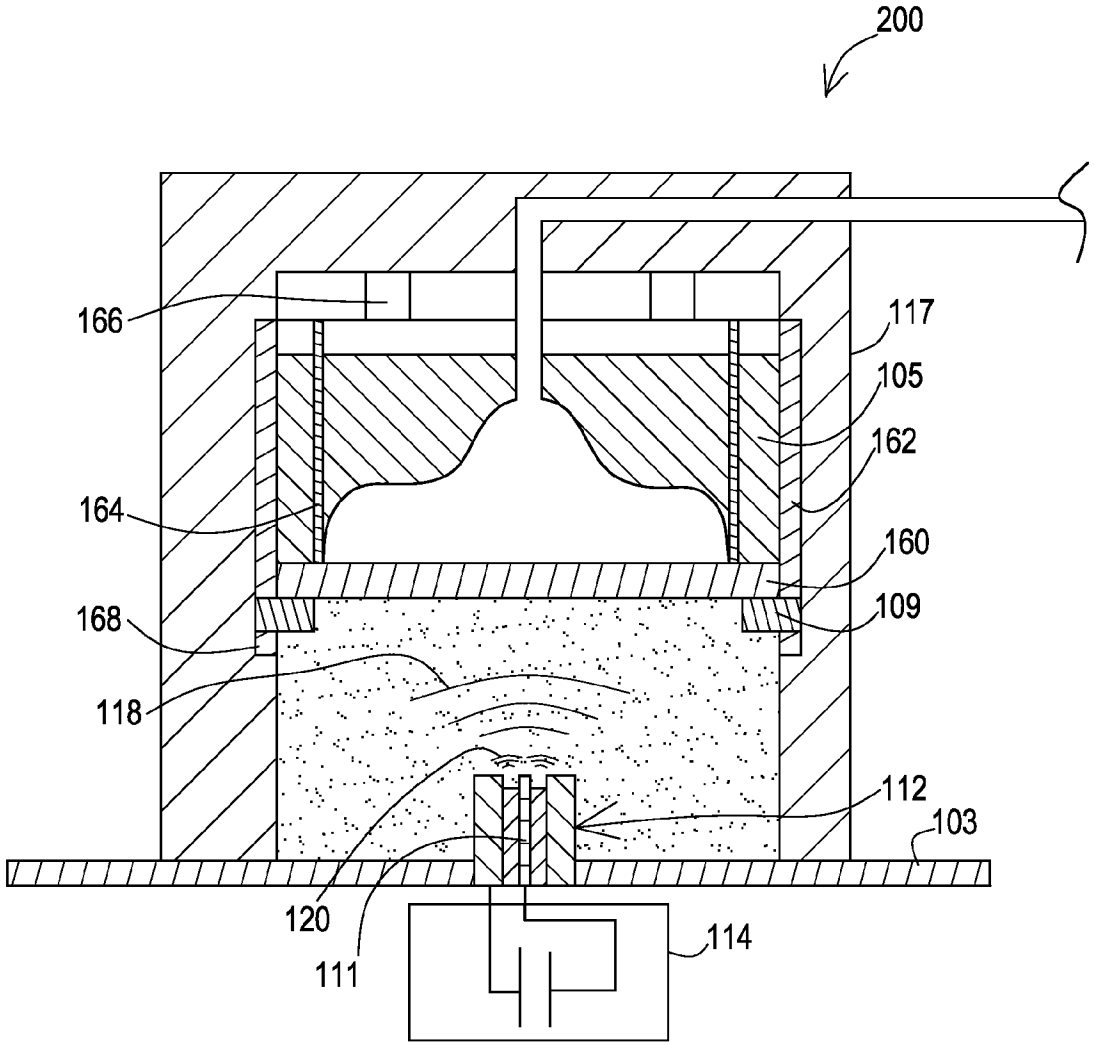
FIG. 11 shows an illustrative embodiment of a device for high velocity forming of components for medical devices with integrated trimming features.

FIG. 11 shows an illustrative embodiment that provides for trimming of the formed workpiece as an integral part of the forming process. Here, the trimming occurs while the formed workpiece remains positioned within the enclosure used for forming and can occur immediately after the forming phase has completed.

This illustrative embodiment of FIG. 11 is a device 200 that includes an enclosure 117 similar to that of the embodiment of FIG. 1. In this example, the enclosure 117 includes a channel 168 that allows the holder 109 to be positioned at a forming location, as shown in FIG. 11, and in a trimming location as discussed below in relation to FIGS. 13 and 14. The die 105 remains in a fixed location during the forming and the trimming phases. It will be appreciated that rather than repositioning the holder 109, the die 105 could instead be repositioned for the trimming phase.

A cutting blade 164 is also present about the contour edge of the die 105. The contour edge is the edge where the forming contour of the die 105 stops. The cutting blade 164 has two positions, a retracted position that is maintained during the forming phase and an extended position that is maintained during the trimming phase. The retracted position prevents the cutting blade 164 from trimming during the forming of the workpiece 160. As the workpiece 160 is being formed, structural changes are occurring within the workpiece 160 including a stretching and bending of the material near the contour edge, so trimming may be delayed until the forming phase is complete to avoid interfering with the stretching and bending of the material.

The holder 109 may include an extension 162 that leads to a drive mechanism 166. Likewise, the cutting blade 164 may also extend to the drive mechanism 166 or to a separate drive mechanism. The drive mechanism 166 may be of various types, such as a hydraulic, pneumatic, electromagnetic, or spring based actuator that can be transitioned between two states so as to move the holder 109 and the cutting blade 164 between the positions used during forming and the positions used during trimming. Furthermore, the drive mechanism 166 may be fully automated, may be automated but utilize a manual user trigger, or may utilize a manual user adjustment.

In the example shown, the die 105 includes a passageway through which the cutting blade 164 may extend as it lies between the drive mechanism 166 and the workpiece 160. Similarly, the extension 162 of the holder 109 may also extend alongside the die 105 or at its edge when being positioned between the drive mechanism 166 and the workpiece 160. However, it will be appreciated that the drive mechanism 166, cutting blades, extension 162 if any, may be positioned in other places within the enclosure 117, such as on the opposite side of the workpiece 160 but out of the path of the pressure wave 118.

Figure 13:
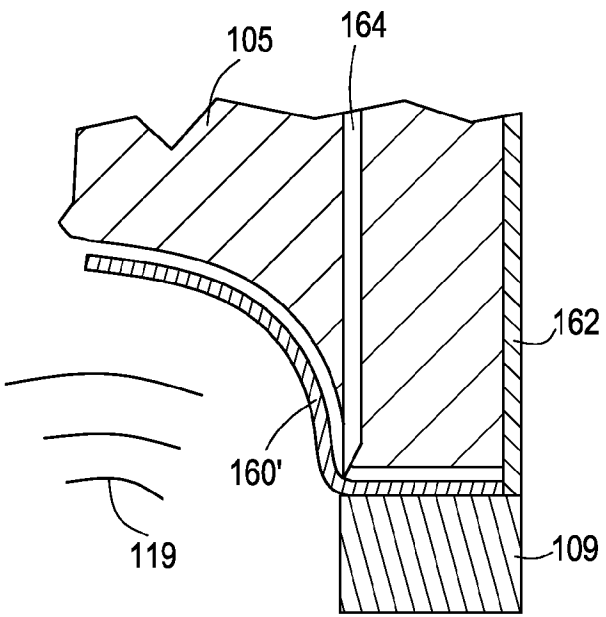
FIG. 13 shows an enlarged view of the trimming features of the embodiment of FIG. 11 when in an extended state and prior to trimming.
Figure 12:
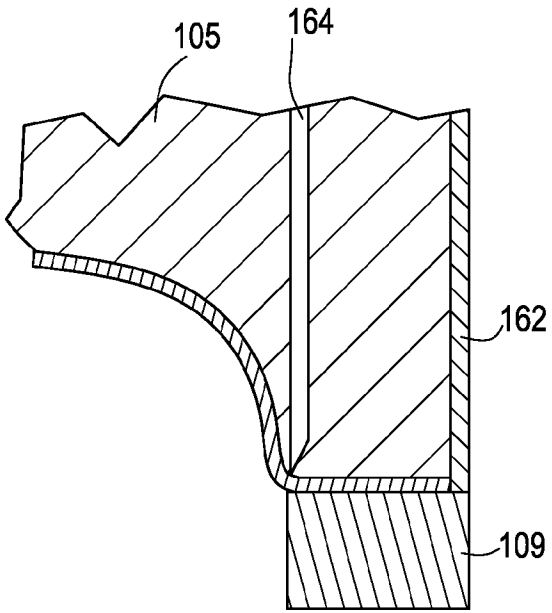
FIG. 12 shows an enlarged view of the trimming features of the embodiment of FIG. 11 when in a retracted state.
Figure 14:
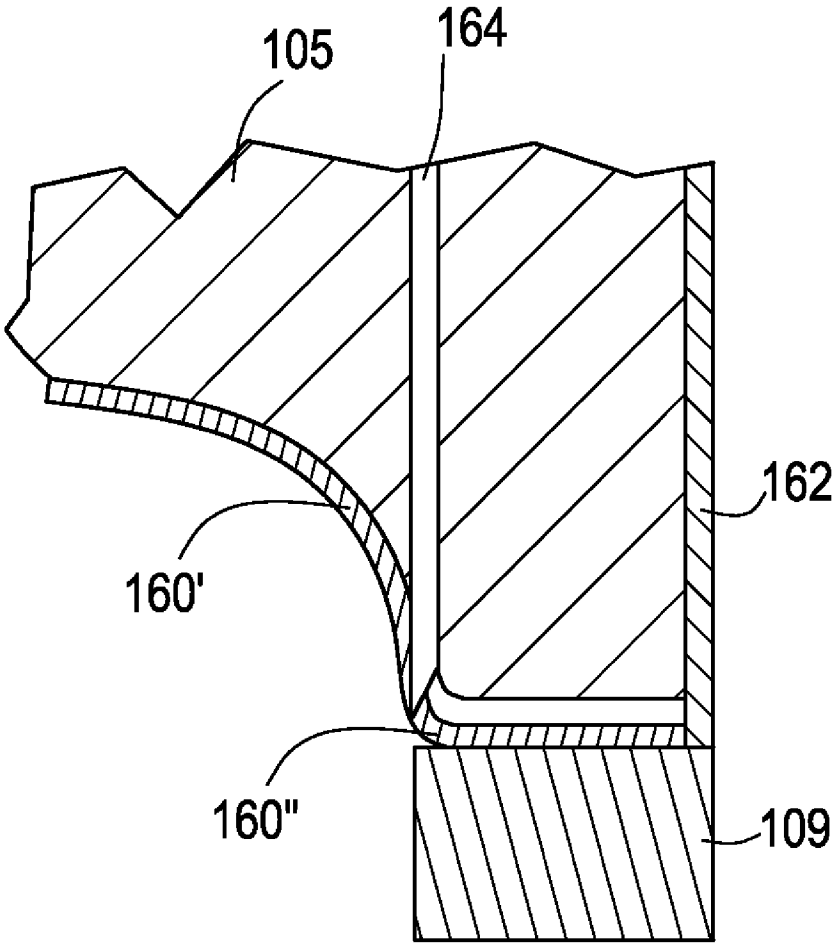
FIG. 14 shows an enlarged view of the trimming features of the embodiment of FIG. 11 when in an extended and after trimming has occurred.

FIGS. 12-14 show a sequence of the trimming phase of the device 100. As shown in FIG. 12, the forming phase has completed and the workpiece 160' is conformed to the contours of the die 105. The cutting blade 164, extension 162, and holder 109 are in the retracted position suitable for the forming phase.

The cutting blade 164, extension 162, and holder 109 are moved to the extended position suitable for the trimming phase as shown in FIG. 13. A small space exists between the formed workpiece 160' and the die 105. Within this small space, the tip of the cutting blade 164 extends beyond the surface of the die 105 at the contour edge to reach the workpiece 160'.

Upon establishing the extended position, a second pressure wave 119 is created by a second spark from the electrode pair 111, 112 of FIG. 11. The second pressure wave 119 forces the workpiece 160' back against the die 105 and as the workpiece 160' already has conformed to the die 105, there is insignificant forming from this second pressure wave 119. However, the workpiece 160' is severed at the contour edge of the die 105 by the extended cutting blade as the workpiece 160' moves into the die 105.

FIG. 14 shows the workpiece 160' after the second pressure wave 119 has occurred to complete the trimming phase. The lip 160" previously integral to the workpiece 160' has been severed. At this point, the workpiece 160' and the lip 160" may be removed from the enclosure 117 for further processing.

Figure 15:
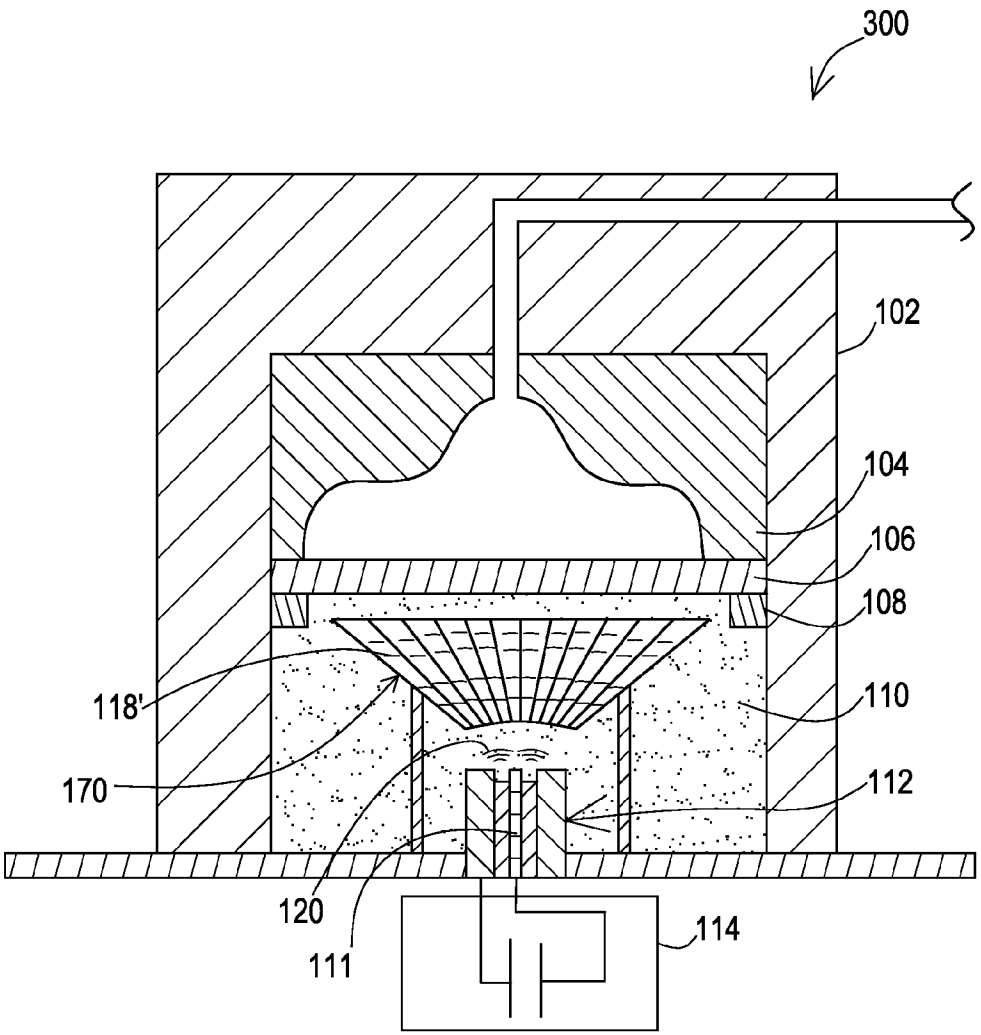
FIG. 15 shows an illustrative embodiment of a device for high velocity forming of components for medical devices with a diffuser.

FIG. 15 shows an illustrative embodiment of a device 300 that provides for diffusion of the pressure wave during the forming process. Here, the enclosure 102 such as that of FIG. 1 includes a pressure wave diffuser 170 that is installed to a fixed position between the electrode pair 111, 112 and the area where the workpiece 106 and the die 104 are located.

In this particular example, the diffuser 170 has a conical shape and may include individual cylindrical or conical channels that lead from the electrode pair 111, 112 to the workpiece 106. The diffuser 170 receives the pressure wave 118' and disperses the pressure wave 118' about the conical space of the diffuser 170. This dispersion prevents the pressure wave 118' from traveling with a small dispersion angle that might result in an inadequate distribution of pressure over the workpiece 106. Thus, a more uniform application of pressure over the entire workpiece 106' may be achieved by dispersing the pressure wave 118' with the diffuser 170. Furthermore, any expanding plasma that accompanies the pressure wave 118 of the liquid may also be dispersed by the diffuser 170 to prevent potentially undesired effects on the workpiece 106' that might otherwise occur.

The diffuser 170 may be constructed of materials similar to those used for other features of the device 300. For instance the diffuser 170 may be constructed as a stainless steel outer cone and/or a collection of cylindrical and/or conical stainless steel channels.

With respect to the various embodiments disclosed above, the features of those embodiments may be combined to provide additional embodiments. For example, a given embodiment may include all of the features of the embodiment discussed in relation to FIG. 1 as well as one or more of the additional features of the embodiments shown in FIG. 6, FIG. 9, FIG. 11, and FIG. 15. Thus, in some embodiments, a single device may have the capability of high velocity forming, while having objects adhered to the die that create custom contours, with trimming being provided as an integral part of the forming process within the device, and with the pressure wave being diffused as it travels to the workpiece.

While embodiments have been particularly shown and described, it will be understood by those skilled in the art that various other changes in the form and details may be made therein without departing from the spirit and scope of the invention.

What is claimed is:

1. A method of creating casings of medical devices, comprising:

providing an enclosure having a first area where a die is present, the die having a surface with a first contour corresponding to a desired contour of a casing section for an implantable medical device;

placing a first workpiece within the enclosure adjacent the die;

at least partially filling the enclosure with a liquid;

creating a first spark within the liquid to produce a pressure wave that forces the first workpiece into the die and causes the first workpiece to achieve the first contour; and mating the first workpiece having the first contour with a second workpiece while including electronic circuitry that performs medical tasks within a space present between the first workpiece and the second workpiece once mated.

2. The method of claim 1, wherein the liquid comprises water.

3. The method of claim 1, wherein the workpiece comprises titanium.

4. The method of claim 1, wherein the first contour comprises a non-smooth surface finish.

5. The method of claim 1, wherein creating the first spark occurs by energizing electrodes with a capacitor bank.

6. A method of creating casing sections of medical devices, comprising:

providing an enclosure having a first area where a die is present, the die having a surface with a first contour;

affixing a first object having a first object contour to the surface of the die at a desired location so that the first object contour and the first contour are combined to provide a second contour;

placing a first workpiece within the enclosure adjacent the die;

at least partially filling the enclosure with a liquid; and creating a first spark within the liquid to produce a pressure wave that forces the first workpiece into the die and causes the first workpiece to achieve the second contour.

7. The method of claim 6, further comprising:

removing the first object from the die;

affixing a second object having a second object contour to the surface of the die at a desired location so that the second object contour and the first contour are combined to provide a third contour;

placing a second workpiece within the enclosure adjacent the die; and creating a second spark within the liquid to produce a pressure wave that forces the second workpiece into the die and causes the second workpiece to achieve the third contour.

8. The method of claim 6, wherein the liquid comprises water.

9. The method of claim 6, wherein the workpiece comprises titanium.

10. The method of claim 6, wherein the enclosure comprises stainless steel.

11. The method of claim 6, wherein affixing the first object to the surface of the die comprises providing a releasable adhesive bond between the first object and the surface of the die.

12. The method of claim 6, wherein creating the first spark occurs by energizing electrodes with a capacitor bank.

13. A device for creating casing sections of medical devices, comprising:

an enclosure;

a pair of electrodes within the enclosure and defining a spark gap;

a die having a first contour; and a first object affixed to the die, the first object having a first object contour, the first object contour and the first contour forming a second contour.

14. The device of claim 13, wherein the enclosure comprises stainless steel.

15. The device of claim 13, wherein the first object is adhesively bonded the surface of the die using a releasable adhesive.

16. A method of creating casing sections of medical devices, comprising:

providing an enclosure having a first area where a die is present, the die having a surface with a first contour, the die further having a contour edge and having an extendable cutting blade around the contour edge;

placing a first workpiece within the enclosure adjacent the die;

at least partially filling the enclosure with a liquid;

while the extendable cutting blade is in a retracted state, creating a first spark within the liquid to produce a pressure wave that forces the first workpiece into the die and causes the first workpiece to achieve the first contour;

after creating the first spark, extending the cutting blade to an extended state; and while the extendable cutting blade is in the extended state, creating a second spark within the liquid to produce a pressure wave that forces the first workpiece into the cutting blade to trim the workpiece along the contour edge.

17. The method of claim 16, wherein the liquid comprises water.

18. The method of claim 16, wherein the workpiece comprises titanium.

19. The method of claim 16, wherein the enclosure comprises stainless steel.

20. The method of claim 16, wherein creating the first spark occurs by energizing electrodes with a capacitor bank.

21. A device for creating casing sections of medical devices, comprising:

an enclosure;

a pair of electrodes within the enclosure and defining a spark gap;

a die within the enclosure and having a first contour and a contour edge; and a cutting blade that extends and retracts about the contour edge.

22. The device of claim 21, wherein the enclosure comprises stainless steel.

23. The device of claim 21, further comprising a control system that triggers a first spark within the spark gap while maintaining the cutting blade in a retracted state, then extends the cutting blade to an extended state, and then triggers a second spark within the spark gap while maintaining the cutting blade in the extended state.

24. A method of creating casing sections of medical devices, comprising:

providing an enclosure having a first area where a die is present, the die having a surface with a first contour corresponding to a desired contour of a casing section;

placing a first workpiece comprising flat sheet stock within the enclosure adjacent the die;

at least partially filling the enclosure with a liquid; and creating a first spark within the liquid to produce a pressure wave that forces the flat sheet stock of the first workpiece sheet into the die and causes the flat sheet stock of the first workpiece sheet to achieve the first contour; and mating the first workpiece having the first contour with a second workpiece while including electronic circuitry that performs medical tasks within a space present between the first workpiece and the second workpiece once mated.

25. The method of claim 24, wherein the liquid comprises water.

26. The method of claim 24, wherein the flat sheet stock comprises titanium.

27. The method of claim 24, wherein the enclosure comprises stainless steel.

28. The method of claim 24, wherein creating the first spark occurs by energizing electrodes with a capacitor bank.

29. A method of creating casing sections of medical devices, comprising:

providing an enclosure having a first area where a die is present, the die having a surface with a first contour;

placing a first workpiece within the enclosure adjacent the die;

at least partially filling the enclosure with a liquid;

creating a first spark within the liquid to produce a pressure wave that forces the first workpiece into the die and causes the first workpiece to achieve the first contour; and diffusing the pressure wave as it travels to the first workpiece; and mating the first workpiece having the first contour with a second workpiece while including electronic circuitry that performs medical tasks within a space present between the first workpiece and the second workpiece once mated.

30. The method of claim 29, wherein the liquid comprises water.

31. The method of claim 29, wherein the workpiece comprises titanium.

32. The method of claim 29, wherein the enclosure comprises stainless steel.

33. The method of claim 29, wherein creating the first spark occurs by energizing electrodes with a capacitor bank.

34. A device for creating casing sections of medical devices, comprising:

an enclosure containing a liquid;

a pair of electrodes within the enclosure and defining a spark gap within the liquid;

a die within the liquid and having a first contour; and a pressure wave diffuser within the liquid and between the spark gap and the die, the pressure wave diffuser comprising a plurality of individual channels.

35. The device of claim 34, wherein the enclosure comprises stainless steel.

36. The device of claim 34, wherein the pressure wave diffuser comprises a conical shape.

* * * * *